US009597250B2

(12) United States Patent
Simeone

(10) Patent No.: US 9,597,250 B2
(45) Date of Patent: Mar. 21, 2017

(54) POSTURE REHABILITATION APPARATUS

(71) Applicant: Emanuele Simeone, Monterotondo (IT)

(72) Inventor: Emanuele Simeone, Monterotondo (IT)

( * ) Notice: Subject to any disclaimer, the term of this patent is extended or adjusted under 35 U.S.C. 154(b) by 0 days.

(21) Appl. No.: 14/441,464

(22) PCT Filed: Nov. 8, 2013

(86) PCT No.: PCT/IB2013/060003
§ 371 (c)(1),
(2) Date: May 7, 2015

(87) PCT Pub. No.: WO2014/076617
PCT Pub. Date: May 22, 2014

(65) Prior Publication Data

US 2015/0257965 A1 Sep. 17, 2015

(30) Foreign Application Priority Data

Nov. 13, 2012 (IT) ..... RM2012A0552

(51) Int. Cl.
*A63B 23/04* (2006.01)
*A63B 23/08* (2006.01)
(Continued)

(52) U.S. Cl.
CPC ..... *A61H 3/00* (2013.01); *A63B 22/0046* (2013.01); *A63B 22/16* (2013.01); *A63B 22/203* (2013.01);
(Continued)

(58) Field of Classification Search
CPC ..... A63B 3/00; A63B 1/00; A63B 26/003; A63B 22/201; A63B 22/203;
(Continued)

(56) References Cited

U.S. PATENT DOCUMENTS 430,808 A 6/1890 Naish
2,109,188 A * 2/1938 Bajanova ..... A63B 69/0064 182/7
(Continued)

FOREIGN PATENT DOCUMENTS

FR 2 522 510 A 9/1983
JP 2007/143753 A 6/2007
(Continued)

OTHER PUBLICATIONS

International Search Report, dated Feb. 24, 2014, from corresponding PCT application.

*Primary Examiner* — Loan H Thanh
*Assistant Examiner* — Nyca T Nguyen
(74) *Attorney, Agent, or Firm* — Young & Thompson

(57) ABSTRACT

Posture apparatus for rehabilitating alterations of the locomotor system includes a rectangular-shaped platform offering housing to two portions and receive a subject user, each portion respectively including a base reversibly respectively fixed to its corresponding portion and adapted to respectively support a support matching the left foot and a support matching the right foot of the subject; a belt with elastic band adapted to be worn by the subject; at least one elastic cord for connecting the belt with support elements present on the apparatus; at least two telescopic rods adapted to fix at a predetermined height the support elements; the apparatus conferring to the anatomic structures involved in the exercise, and to the feet of the subject, a high number of degrees of freedom of movement, with the matching feet supports divided into two transverse portions which allow the foot to perform a natural helical movement.

20 Claims, 5 Drawing Sheets

(51) Int. Cl.

| | |
|---|---|
| ***A61H 1/02*** | (2006.01) |
| ***A61H 3/00*** | (2006.01) |
| ***A63B 69/00*** | (2006.01) |
| ***A63B 22/00*** | (2006.01) |
| ***A63B 22/16*** | (2006.01) |
| ***A63B 22/20*** | (2006.01) |
| ***A63B 26/00*** | (2006.01) |
| *A63B 71/06* | (2006.01) |

(52) U.S. Cl.
CPC ..... *A63B 26/003* (2013.01); *A63B 69/0064* (2013.01); *A61H 2003/001* (2013.01); *A63B 21/4009* (2015.10); *A63B 23/047* (2013.01); *A63B 2022/0038* (2013.01); *A63B 2022/0094* (2013.01); *A63B 2071/0647* (2013.01); *A63B 2208/0204* (2013.01); *A63B 2209/10* (2013.01)

(58) Field of Classification Search
CPC ..... A63B 21/4009; A63B 21/0023; A63B 21/023; A63B 21/025; A63B 69/0064; A63B 69/18; A63B 23/10; A63B 23/0429; A63B 21/4034; A63B 23/04; A63B 23/0405; A63B 23/0417; A63B 23/0464; A63B 23/0476; A61F 5/0111; A61H 3/00; A61H 1/0266; A61H 2205/12; A61H 2205/125; A61H 1/02; A61H 1/0237; A61H 2001/0203
USPC ..... 601/27, 28, 29, 32, 35
See application file for complete search history.

(56) References Cited

U.S. PATENT DOCUMENTS

| | | | | | |
|---|---|---|---|---|---|
| 3,741,540 | A * | 6/1973 | Shimizu | A63B 23/085 | 482/128 |
| 4,376,532 | A * | 3/1983 | Hunstad | A63B 69/18 | 482/146 |
| 4,619,352 | A | 10/1986 | Shoji et al. | | |
| 5,176,597 | A * | 1/1993 | Bryne | A61H 3/008 | 482/54 |
| 6,264,584 | B1 * | 7/2001 | Bass | A63B 21/4009 | 482/54 |
| 6,458,036 | B1 * | 10/2002 | Gutierrez | A63B 69/0059 | 473/207 |
| 6,676,569 | B1 | 1/2004 | Radow | | |
| 6,761,666 | B2 * | 7/2004 | Chou | A63B 22/0056 | 482/52 |
| 6,767,313 | B2 * | 7/2004 | Sayce | A63B 69/18 | 482/146 |
| 7,413,553 | B2 * | 8/2008 | Chen | A61H 1/003 | 601/104 |
| 7,618,355 | B1 * | 11/2009 | Murdock | A63B 21/153 | 482/110 |
| 8,827,882 | B2 * | 9/2014 | Rogers | A63B 26/003 | 482/146 |
| 2008/0103032 | A1 * | 5/2008 | Jacob | A63B 21/4009 | 482/124 |
| 2010/0000546 | A1 * | 1/2010 | Park | A61H 3/008 | 128/845 |
| 2010/0268129 | A1 * | 10/2010 | Park | A61H 1/0237 | 601/35 |
| 2011/0111927 | A1 * | 5/2011 | Kim | A63B 21/00192 | 482/52 |
| 2013/0079196 | A1 * | 3/2013 | Frey | A61H 1/003 | 482/4 |
| 2014/0011645 | A1 * | 1/2014 | Johnson | A63B 21/4033 | 482/121 |
| 2014/0031175 | A1 * | 1/2014 | Peralo | A61H 1/02 | 482/66 |
| 2014/0315694 | A1 * | 10/2014 | Singh | A63B 23/085 | 482/79 |
| 2015/0140534 | A1 * | 5/2015 | Brunner | A63B 22/025 | 434/255 |

FOREIGN PATENT DOCUMENTS

| | | | |
|---|---|---|---|
| WO | 00/40199 | A1 | 7/2000 |
| WO | 2006/118377 | A1 | 11/2006 |
| WO | 2008/116228 | A2 | 9/2008 |

* cited by examiner (a)

(b)

POSTURE REHABILITATION APPARATUS

The present invention regards a new posture rehabilitation instrument apparatus. In particular, the present invention refers to a posture rehabilitation apparatus comprising a set of elements adapted to induce the rehabilitation posture of the subject in upright position and in the gait cycle, so as to cause specific and improved ergonomic movement actions in the correct movement gestures in the subject, initially altered by diseases and rheumatic and traumatic diseases of the locomotor system and, specifically, the components of the lower limb and the vertebral column.

STATE OF THE ART

The progress of posture and bioengineering studies has proven that there are a large number of diseases related to the posture of individuals. The alterations of the posture, the posture tonic system and the connective system, are also common in all human organisms mainly due to the flat ground. Actually, the latter is the main cause of the physiological modification of the curve of the rachis, from which abnormalities and dysfunctions arise, over time and according to the specific characteristics of each subject, both at skeleton and organic muscle level, over the entire body of the subject.

Actually, the human skeleton muscle system, along with the posture control, has developed over millions of years so as to allow the human being to best adapt to the natural ground, which is uneven. In addition, the skin exteroceptors and the foot proprioceptors represent connection elements between the human organism and the external environment, hence they play a very important role when it comes to the determination of the posture and thus in the development of the skeleton and stomatognathic muscle system. Modern studies have revealed that human beings poorly adapt to flat ground. Actually, the human organism operates in a cybernetic manner capable of adapting, self-adjustment and self-programming.

According to the information received instant by instant, from the external and internal environment the human organism constantly tends to attain the dynamic balance conditions, commonly referred to as homeostasis. Though representing a cybernetic system, it is however exposed, like all systems of this type, to adjustment and programming errors which increase as the number of perturbations—and more in detail external stimuli—reduces. In other words, the more and different the environmental information the human organism receives, the more it is able to perform fine and correct adjustment of the operation thereof. Thus, contrary to what occurs when living on a natural ground, a flat ground having an even and constant configuration provides little stimuli for the human organism. Thus, the posture error on the flat ground is much higher than that possibly deriving from the uneven ground. Posture alterations and dysfunctions deriving from a flat ground, as well as from other non-ergonomic artificial surfaces such as seats and/or desks, are the cause of many muscle problems at skeleton and organic level. Actually, the human posture system reacts to these non-ergonomic external factors by actuating compensations which are efforts required of the tonic system by the brain hence forcing the muscles, articulations, nerves, etc. to assume a posture that is as stable as possible on an artificial surface. The lumbar hyperlordosis for example represents the main posture alteration of the human organism due to the flat ground, and it is caused by an excessive curving in the lower area of the back. The flat ground, in any case, is not the only source of the posture alterations which may then degenerate into actual diseases; for example high heels represent one of the main causes which lead to an increase of the lumbar hyperlordosis and directly proportional to the height of the heel.

Thus over time, even relatively small posture errors are capable of causing discomfort first and diseases then: overloads with ensuing joint degeneration, such as arthrosis, meniscopathy etc., stiffening and degeneration of elastic tissues such as tendinopathy, myopathy etc., trapping of the nerves, airway obstruction, digestion disorders, poor circulation, balance problem, psychological disorder etc.

Furthermore, it is clear that the right solution to posture disorders cannot be represented by the continuous taking of drugs or surgery. They should respectively represent temporary synergistic and rare steps and indispensable exceptions. It has been revealed that correct therapeutic approach should especially aim at realigning posture, or normalizing the general barycenter of the body through stimuli capable of creating—in the cybernetic of the human balance—new and more functional posture strategies, or new engrams (motor pattern). In particular, the motor engrams represent the entirety of motor experiences memorized by the individual following programming induced from the external. Thus, the more the human organism tends to repeat—automatically or subconsciously—given functional motor actions, the more it tends to reinforce a given motor pattern. Thus, it is clear that all the modern studies and technologies aim at restoring the correct motor actions both when moving or at a standstill, thus rehabilitating the posture tonic system in a more physiological manner.

Up to now, technology allows performing given posture tests which utilize specific and advanced evaluation and control instruments, such as computerized gait analysis such as baropodometry, stabilometry, electromyography of the surface etc. By analyzing the kind of posture disease or dysfunction observed, these techniques allow designing, for each specific case, the ideal human/environment interface, that is the ideal ergonomic footwear or insole that best suits the subject. Thus, the latter feeling a ground more suitable thereto will immediately start posture adjustment. However, these innovative devices, along with the common ergonomic insoles, must be accompanied by a rehabilitation program possibly including massages, physical exercise, stretching and muscle reinforcement, joint mobilization, motor rehabilitation, posture exercises, breathing rehabilitation and instrument physiotherapy.

Regarding this, an object of the present invention, which shall be described in detail hereinafter, is to provide a new apparatus, adapted for obtaining the posture rehabilitation by simultaneously performing a plurality of operations, due to the presence of specific components. The latter, in particular, confer, to the user of the apparatus, an increase of the degrees of freedom of movement with respect to those regarding the instruments currently used for posture rehabilitation purposes. The increase of the degree of freedom of movement leads to obtaining a new and more physiological motor pattern, thus further leading to clear posture improvement results which can be obtained within relatively short periods of time. Due to the observations and clinical evidence of various experts as regards motor learning, about the dynamics and the kinematics of the movement, alongside engineering and neuroscience studies, it has been observed that the plasticity and adaptability to the context of human beings, and common to many living things, are caused by stimuli which, at various levels, cooperate to determine the aim of a motor action. In brief, an even ground, along with the perfectly flat seating of a seat or the car seat, create problems for our motor system in terms of generating context adaptive response. This difficulty occurs with a stereotyped and fixed response which limits the range of possible solutions of the motor system to adapt. Our motor system is inherently organized in a manner such to always require different stimuli in order to be adaptive. Neurological diseases represent a clear example of limitation of the motor responses, when faced with various situations naturally poised by the environment. Basically, the disease somehow limits the capacity of the subject to capture these essential significant/insignificant elements (affordance), adapted to determine a targeted and ergonomic motor behavior. Actually, there are various elements that represent actual attraction states for the system in the environment. These elements are carriers of significant information indispensable for generating a fine motor action. Actually, our nervous system is not capable of generating an adaptive response to an unknown stimulus. The stimuli that the environment offers to the subject spontaneously and from a given time have the possibility of being revealed by our motor system and gain significance in that specific context and at that specific time. For example, when walking on various surfaces (sand, rock, grass) and we have the historic knowledge of these environments, our foot shall be immediately configured to adapt to the ground; on the contrary, were we to walk on an unknown surface, or walk with blindfolded eyes, both cases shall require new motor strategies to tackle the environment in question. The significance of the stimulus, and the innate capacity to capture it, allows perfect adaptation to the environment. The motor system for generating a response shall thus necessarily be compared with the environment and the characteristics thereof depend on the information channels (sight, hearing, touch, balance, . . . ). Thus, there cannot be a targeted and ergonomic motor action without the nervous system being capable of capturing and elaborating a stimulus. Our neuromotor system is substantially a generator of motor patterns, determined by the capacity of receiving significant elements in the environment. These elements, disturbing the state of activation of the nervous system, cause the depolarization of the membrane of the neuron and cause a motor response thereof for adaptation to the capacity that the system can offer in that specific time. The continuous capacity of modification of the living systems, the cellular replication, requires—and it could not be otherwise—producing different adaptive and performing responses. As we grow up, with time we learn to capture and process each significant, preferably unique, stimulus adapted to generate an adaptive response, thus we are not organized to give a response to a stimulus that is always identical and repeated severally over time. What may currently be an element that determines the generation of a motor action, shall no longer be such after a short time. Thus, we always need to receive new and different significant stimuli so as to continuously adapt to the context, otherwise it will lead to failure which in turn leads to functional limitation, degeneration of the tissue and pain, this being caused by a repetitive and stereotyped response which are rather damaging for the living system. Thus, the rehabilitation acquires an ecological feature, where ecological is used to mean the condition that is key to changing the environment, for training the function and generating adaptability, exactly as imposed by the laws of the living systems. The apparatus object of the present invention is the direct consequence of the information outlined above. By continuously varying the coefficient of resistance, rigidity and elasticity of the elements that form them, during the entire work session, the springs and/or actuators systems offer the subject a unique therapeutic context, or rather a perfectly disturbing "environment", which leads to finding continuous motor solutions, thus allowing the treated subject to be configured in a functional and ergonomic manner in various daily activities. Varying the therapeutic context means causing the subject, through an always varying and unpredictable stress, to be adaptively configured responding to the changing environment, to which the subject must respond with an adaptive motor behavior. Thus the generated disturbances lead to stressing all elements subtended to the proprioception (muscle spindle, Pacini's and Golgi's organs etc. present in the soft tissues: muscles, tendons, joint capsules, ligaments and the bundle system) which—depending on the activity of the background tone—are active and which, upon the variation of intensity of the duration and the stress quality, are exited thus transmitting nervous pulses suitable to create synergy between the motor components. The device subject of the present invention is used for generating "adaptability". Conceptually, this is the specific detail that distinguishes them—in an innovative and distinct manner—and it is the neuromotor concept around which the present invention is based.

DESCRIPTION

The present invention describes a new posture rehabilitation apparatus that applies the concept regarding the ecologic rehabilitation, according to which—varying the environment or the therapeutic context—the subject is constantly required to find new posture strategies. The subject shall tend to learn new posture strategies just as if learning how to use new words, where each word represents a motor action. In particular, the system in question is capable of actuating a posture rehabilitation process conferring to the user of said system the possibility of performing a high number of movements and in particular orientations of the locomotor system thereof. The rehabilitation with the apparatus described herein is obtained by determining, in the patient, the construction of new and more physiological motor patterns. More in detail, the system in question comprises three main elements such as a platform adapted to offer support to the feet, a belt to which one or more elastic cords are applied and adapted to be worn by the subject user of the described apparatus, and a telescopic rod anchoring system. The apparatus subject of the present invention allows actuating the rehabilitation posture of the subject in upright position and/or in the gait cycle and it is particularly adapted to cause a rehabilitation of posture alterations caused by diseases and rheumatic and traumatic diseases of the locomotor system and more specifically the lower limb and the vertebral column. Thus, the novelty of this instrument lies in providing the dynamic sustainment elements, represented by the springs, by actuators, by the central articulation and by the transverse axis which—overall—reproduce the functions carried out by the articulations of the foot, i.e., bending, extension, pronation and supination. Thus, there occurs the reproduction of the inverse helical system (tarsometatarsal articulation) and dorsal foot bending, ((astragalo-calcaneal) joint) and even the prono-supination.

The perturbations offered by these systems (springs, actuators and elastic elements) determine an actuation of the systems adapted to generate functional motor patterns.

When using this apparatus, the subject of the present invention tends to structure the adaptability capacity to the context: (environment) and this allows being ergonomic and create highly fine and performing motor actions. This apparatus perfectly fits in a rehabilitation approach of the "ecological" type where the stimuli offered by the environment (by the therapeutic context in this case) can be captured and transformed into specific targeted actions. Even more in detail the rehabilitation posture apparatus described in the present industrial invention patent application is particularly suitable for the rehabilitation of anatomic structures such as:

- Foot, by correcting: monolateral or bilateral valgus and/or varus positions, flat and/or supine positions, pronated and/or talus positions, arthrosis and arthritis in the tibiotarsal joints, tarsometatarsal joints, metatarsophalangeal joints, astragalo-calcaneal joint, tarsalgia, metatarsalgia, plantar fasciosis, calcaneal spur, diseases of the Achilles tendon, heel pain, enthesopathy, hypotonia and/or hypotrophy of the intrinsic and extrinsic musculature of the foot, involved alterations, alterations of the ligamentous and tendinous capsule components of the foot articulations;
- Knee, by correcting: monolateral or bilateral valgus and/or varus position, recurvatum of the knee, patellofemoral arthrosis and arthritis, patella hyperpressure syndrome, chondropathy, enthesopathy, tone alteration and/or trophism alteration of the intrinsic and extrinsic musculature of the knee, alterations involving the ligamentous, meniscus and tendinous capsule components of the knee articulation;
- Hip, by correcting: monolateral or bilateral position, in external and internal rotation of the coxofemoral joint, coxarthrosis, impingement syndrome, chondropathy, tone alterations and/or trophism alteration of the intrinsic and extrinsic musculature of the hip, alterations involving the ligamentous and tendinous capsule components of the hip;
- Pelvis, by correcting: anteversion, retroversion, inclination and/or rotation position of the pelvis, arthrosis and arthritis of the sacroiliac joints and of the pubic symphysis, pyriform syndrome, alterations involving the ligamentous and tendinous capsule components of the pelvis articulation;
- Spinal column, by correcting: alternations and/or modifications of the physiological curves of the rachis and pathological positions thereof, such as scoliosis, rotoscoliosis, scoliotic position, juvenile osteochondrosis of the spine, etc. Spondyloarthrosis, inflamamtory diseases and/or degenerative diseases of the rachis, facet syndrome, tone alteration and/or trophism alteration of the intrinsic and extrinsic musculature of the rachis, alterations involving the ligamentous and tendinous capsule components of the intervertebral articulations.

The posture rehabilitation apparatus, object of the invention, is also adapted to correct alterations of the gait cycle due to neuropathies of central and peripheral type, alterations of equilibrium control, alterations of the proprioception as a result of disease, and in the proprioceptor training for athletic movement. Said rehabilitation apparatus is also adapted to correct alterations correlated with the temporomandibular joint in relation to the posture. The use of the posture rehabilitation apparatus can also preferably be actuated after having collected information on the patient, such as case history data, height, weight, foot size, instrumental diagnostic exams such as radiography, magnetic resonance, CAT, electromyography, baropodometry, gait analysis with optoelectronic systems, video analysis and objective examination of the subject, in a manner such to allow the patient's assignment in a specific field of application of the present rehabilitation system.

The use of said apparatus includes the following steps consisting in:

a) positioning the subject on the platform of said instrument apparatus in upright position with the feet resting on special sustainment elements, depending on the dimensions of the feet. The position of the feet may also be parallel or in semi-gait position, the width depends on the height of the subject and the exercise intended to be performed. The orientation of the foot is also measured according to the lower limb. The rearfoot and forefoot position is configured according to the coefficient of rigidity of a system of springs, or actuators, so as to cause the inversion or eversion of the feet and the unwinding movement of the helix between the forefoot and the rearfoot.

b) Fixing, at the height of the pelvis, the belt system with an elastic band suitably adjusted according to the circumference of the subject; actually, the band has an anatomic conformation which surrounds the pelvis at the height of the iliac wings laterally, so as to confer to the subject greater support in the latero-sideways movement thereof. In addition, these elastic systems shall be used in a number deemed suitable by the operator for the exercise that shall be performed by the subject and depend on the height and the weight of the subject; these systems are fixed to a height-adjustable multiple telescopic rod system.

c) Taking, by the subject user of the rehabilitation apparatus, a given position, such as for example that corresponding to the position of the feet in parallel configuration and the application of the elastic system at the front part and/or at the rear part, and/or the one corresponding to the positioning of the feet parallel configuration and the application of the elastic system laterally, rightwards and/or leftwards, and/or the one in the right and/or left semi-gait with elastic system applied at the front part and/or at the rear part.

Besides the rotation movement, the posture rehabilitation apparatus, subject of the present invention, also allows adjusting the inclination of the foot according to the median axis of the body: this occurs due to a free-lockable system preferably made of polycarbonate and fixed with screws and washers, preferably made of steel, to support bases of the feet, resting on the platform, housing said screws or washers in the platform.

The belt with elastic band comprised in the apparatus in question is also preferably made of fabric and it has a closing/opening system with Velcro and at least two points and preferably four fixing points for the elastic cords. Depending on the waist circumference of the subject, on which the length of the band depends, the slits are arranged at the front part, at the rear part and on the two sides of the pelvis of the subject, where the belt is higher due to a greater adherence at the iliac wings. The coefficient of rigidity of the elastic elements depends on the weight and the height of the subject. Said belt with elastic bands is in turn connected to the sustainment elements fixed through telescopic supports, and preferably to four telescopic supports, adjustable according to the height of the subject and arranged at the front part, at the rear part and laterally to the platform. The posture rehabilitation apparatus described in the present invention is also optionally provided with video systems which project the images of the region of the foot/feet interested by the rehabilitation.

The rehabilitation apparatus allows the subject to perform a given exercise according to the inversion and/or eversion movements of the rearfoot and/or of the forefoot also due to the presence of reference axes arranged on the medial and/or lateral sides of the platform and supported by a system which allows the fixing thereof at a predetermined height.

BRIEF DESCRIPTION OF THE DRAWINGS

FIG. 1(*b*) shows a front view of one of the components of the apparatus 1 subject of the present document. In particular the figure shows a front view of the belt 3 with elastic band adapted to be worn by the subject user of the apparatus 1. More in detail, observing the FIG. 1(*b*), it shows the presence of an opening/closing system 20 of the belt 3, made of Velcro, and a plurality of—four in the specific case-fixing points 21 adapted to the connection of elastic cords 4 (the latter not shown in the figure). FIG. 1(*b*) also shows the presence of projections 28 on the sides of the belt 3 adapted to confer, to the subject user of the apparatus 1, greater support. The projections 28 are actually shaped according to the iliac wings of the waist of any person.

FIG. 2 shows that the two portions 2' and 2" respectively house a base 6' and a base 6" reversibly fixed to the platform through at least one dowel 24 to be inserted and fixed in a corresponding hole 23 for each base 6' and 6". The figure shows that on the bases 6' and 6" supports 7' and 7" are also present respectively. The latter are respectively configured so as to match the left foot and to the right foot of a person. Each support 7' and 7" is also divided into two transverse portions. More in detail, the figure shows that the support 7' is divided into portion 8' corresponding to the left forefoot, and portion 8" corresponding to the left rearfoot, while the support 7" is divided into portion 9' corresponding to the right forefoot and portion 9" corresponding to the right rearfoot. Said portions 8' and 8" for the support 7' and said portions 9' and 9" for the support 7" are also mobile with respect to each other. More in detail, the portion 8' is mobile with respect to the portion 8" and the portion 9' is mobile with respect to the portion 9". In addition, the figure shows the presence of fins 19, provided with pins, adapted to adjust the height of the supports 7' and 7" with respect to the bases 6' and 6" and also adapted to adjust the inclination thereof with respect to said bases.

FIG. 3(*a*) also shows the presence of cylindrical and longitudinal rod 10, preferably made of steel which allows the rotation of said portions 8' and 8" with respect to the longitudinal barycenter axis of said rod 10. An analogous movement due to an analogous rod 10 involves the portion 9' and the portion 9" of the support 7" (not shown in the figure). FIG. 3(*a*) also shows the presence of a pair of elements 11 and 12 underlying respectively the portion 8' and 8" of the support 7'. Said pair of elements 11 and 12 is shaped so as to constrain the portion 8' to the portion 8" and simultaneously allow the rotation of said portions 8' and 8" with respect to the rod 10, the pair of elements 11 and 12 constituting a housing for the rod 10. This configuration is adapted to allow the physiological helical movement between forefoot and rearfoot. As observable in the figure, the support 7' (same case also applying to the support 7") of the posture rehabilitation apparatus 1, is such to have on the lateral surfaces of the portion 8' and 8" respectively at least one hole 13 and at least one hole 14 adapted for the insertion of a rod 15 to be applied to quantify, —on a graduated scale—, the movement of the anatomic structure around the longitudinal barycenter axis. The figure also shows the presence of a plurality of springs 18 interposed between the portions 8' and 8" and the underlying sustainment element 17'. More in detail, as shown in FIG. 3(*b*), which represents a plan view of the base 6' and base 6", and of the respective supports 7' and 7", the lower surfaces of the portions 8' and 8" and 9' and 9", have a plurality of holes 16 adapted to house an end of said springs 18. In addition, each of these has the other end inserted in a hole corresponding to the aforementioned holes 16 and arranged on the upper surface of the supports 7' and 7". 17' and 17".

FIG. 4 shows a perspective view of an embodiment of the apparatus 1. The figure shows the presence of the elastic cords 4 connected to the belt 3, worn by the subject user of the apparatus 1, and also connected to the cord supports 22 arranged at the front part and/or at the rear part and/or laterally to the subject and supported by the telescopic rod system 5. The figure also shows the reference axes 25 arranged laterally to the platform and adapted to allow the subject of to perform a given exercise. Said reference axes 25 are also fixed at a predetermined height due to the presence of the telescopic rod 5 on which said reference rods 25 rest. As observable from the figure, the apparatus 1 optionally comprises a video system 26 capable of projecting the images of the region of the anatomic structure interested by the exercise.

FIG. 5 shows the presence of the actuators 30, represented by cylindrical pistons provided with a common electric motor, adapted to automatically allow the rotation of the supports 7' and 7" with respect to the central axis thereof.

DESCRIPTION OF THE EMBODIMENTS

Figure 1:
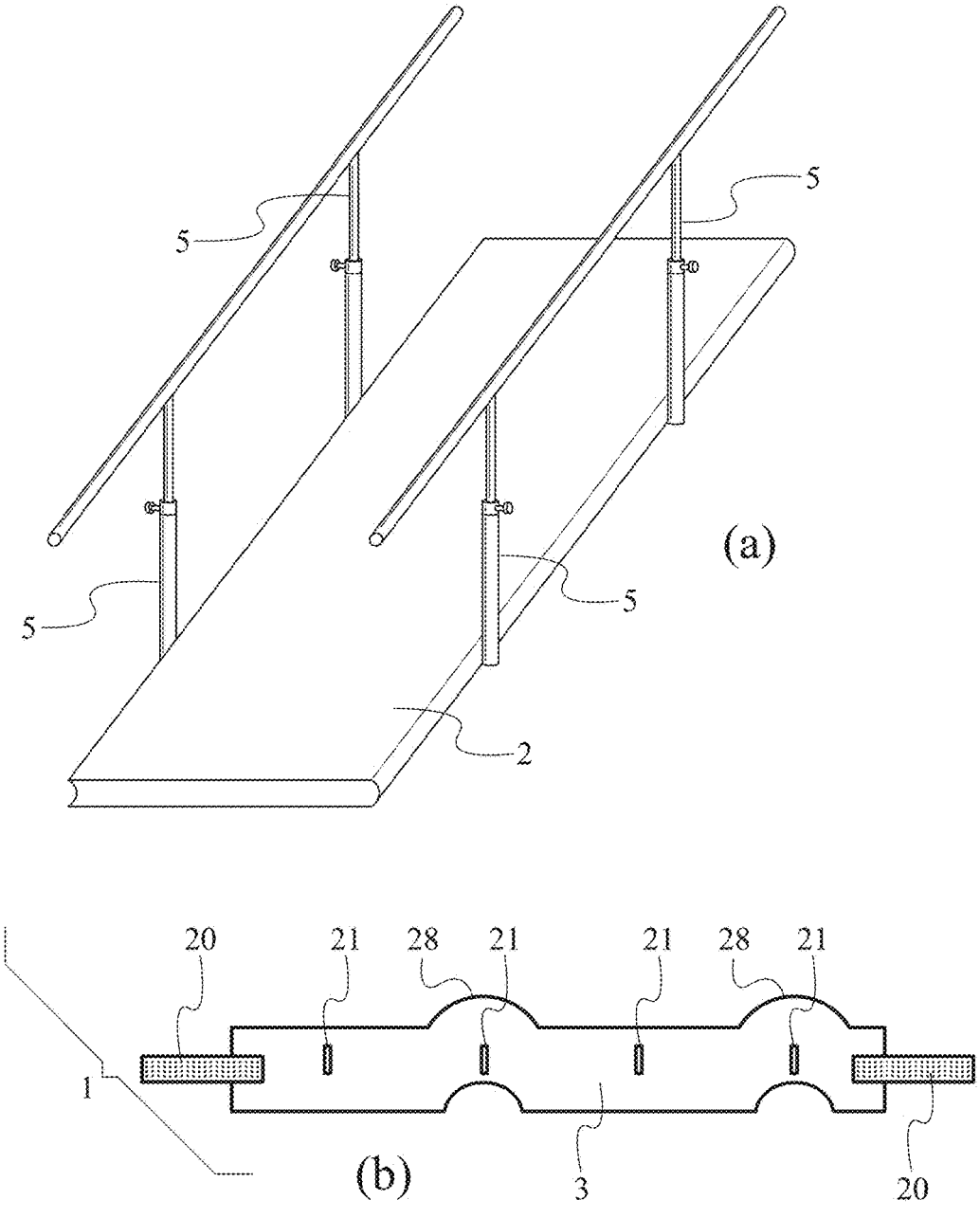
FIG. 1 shows a front and perspective view of some of the components of the posture rehabilitation apparatus 1 subject of the present invention. More in detail FIG. 1(*a*) shows a perspective view of the platform 2 adapted to receive the user of the apparatus 1 in upright position and/or in the gait cycle. The figure also shows a telescopic rod system 5.
Figure 2:
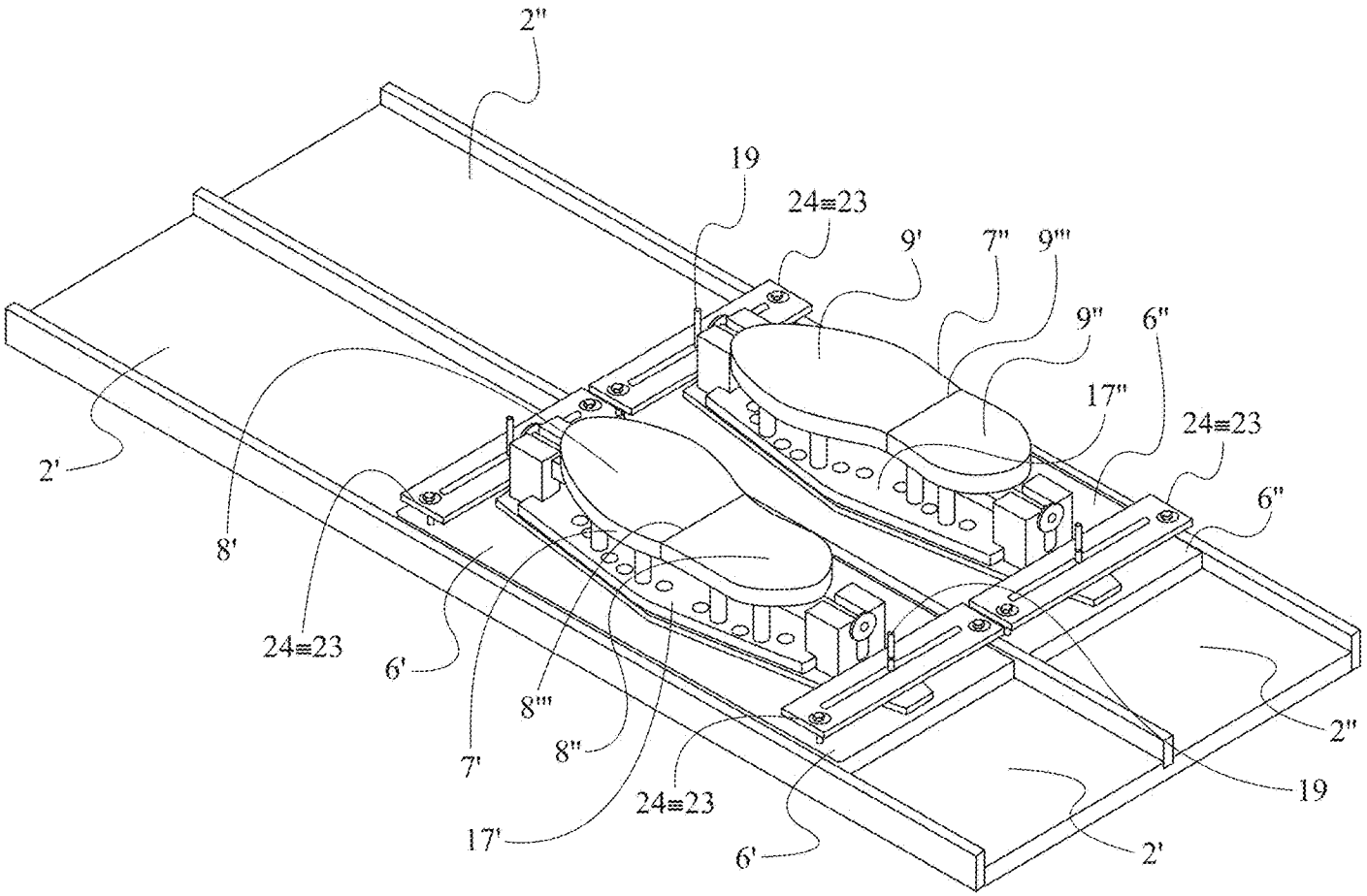
FIG. 2 shows a perspective view of the portions 2' and 2" housed on the platform 2 and the components supported by said portions 2' and 2". More in detail.
Figure 3:
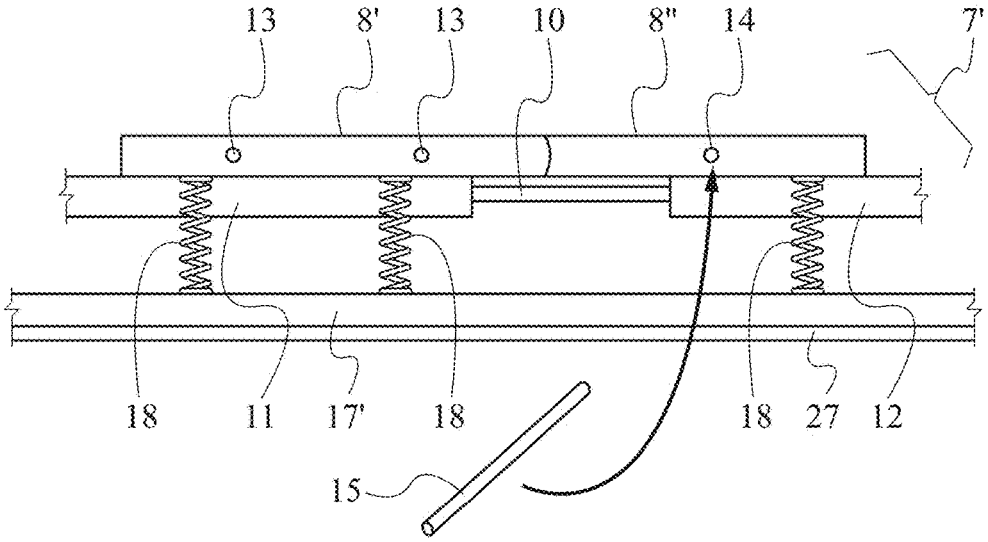
FIG. 3 shows a lateral and plan view of some components housed on the platform 2. More in detail, FIG. 3(*a*) shows a lateral view of the support 7' of the apparatus 1 subject of the invention. More in detail, FIG. 3(*a*) shows the presence of an anti-slip layer 27, preferably made of polycarbonate, underlying the support 7'. More in detail, said polycarbonate layer 27 is interposed between the upper surface of the base 6' (and 6") and the sustainment element 17' (and 17") underlying the portions 8' and 8" of the support 7' (the support 7" not shown in the figure is also characterized analogously).
Figure 3:
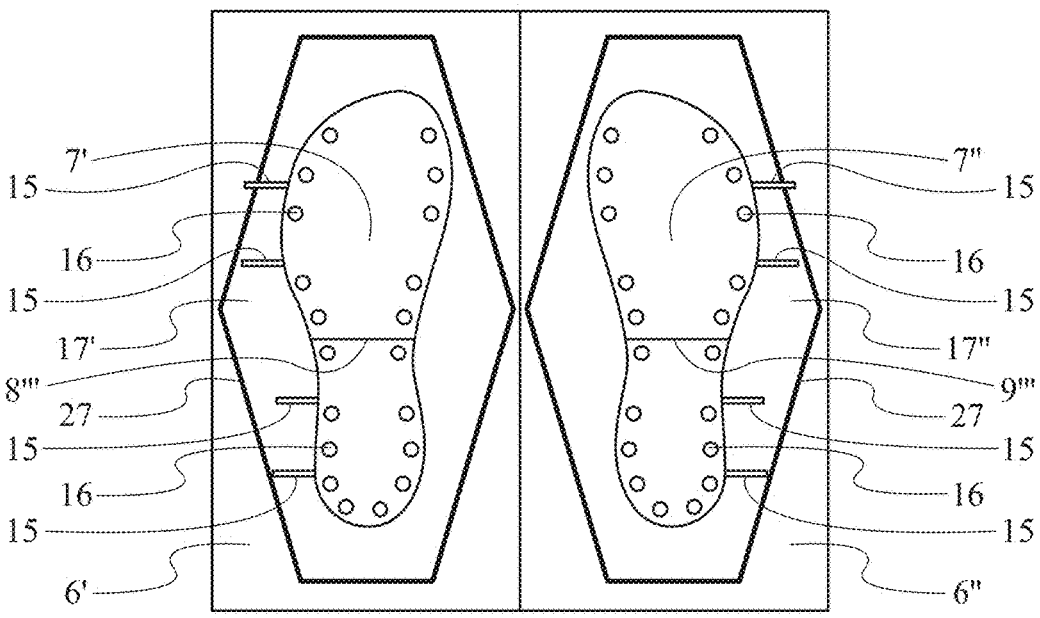
Figure 4:
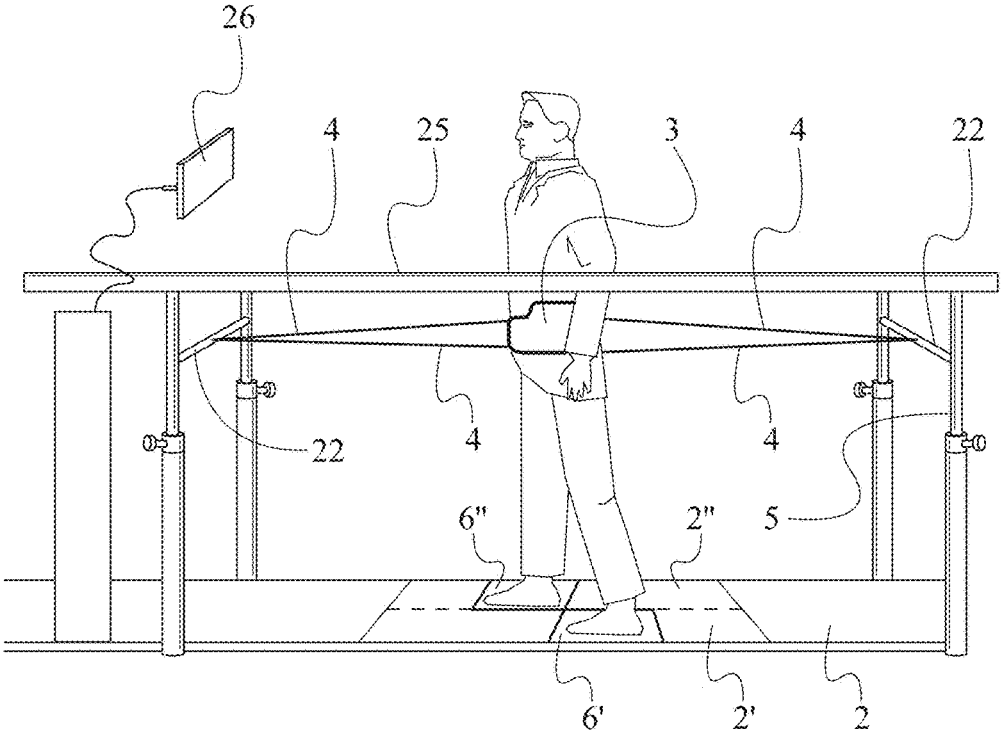
FIG. 4 shows a perspective view of the posture rehabilitation apparatus subject of the present invention. More in detail.
Figure 5:
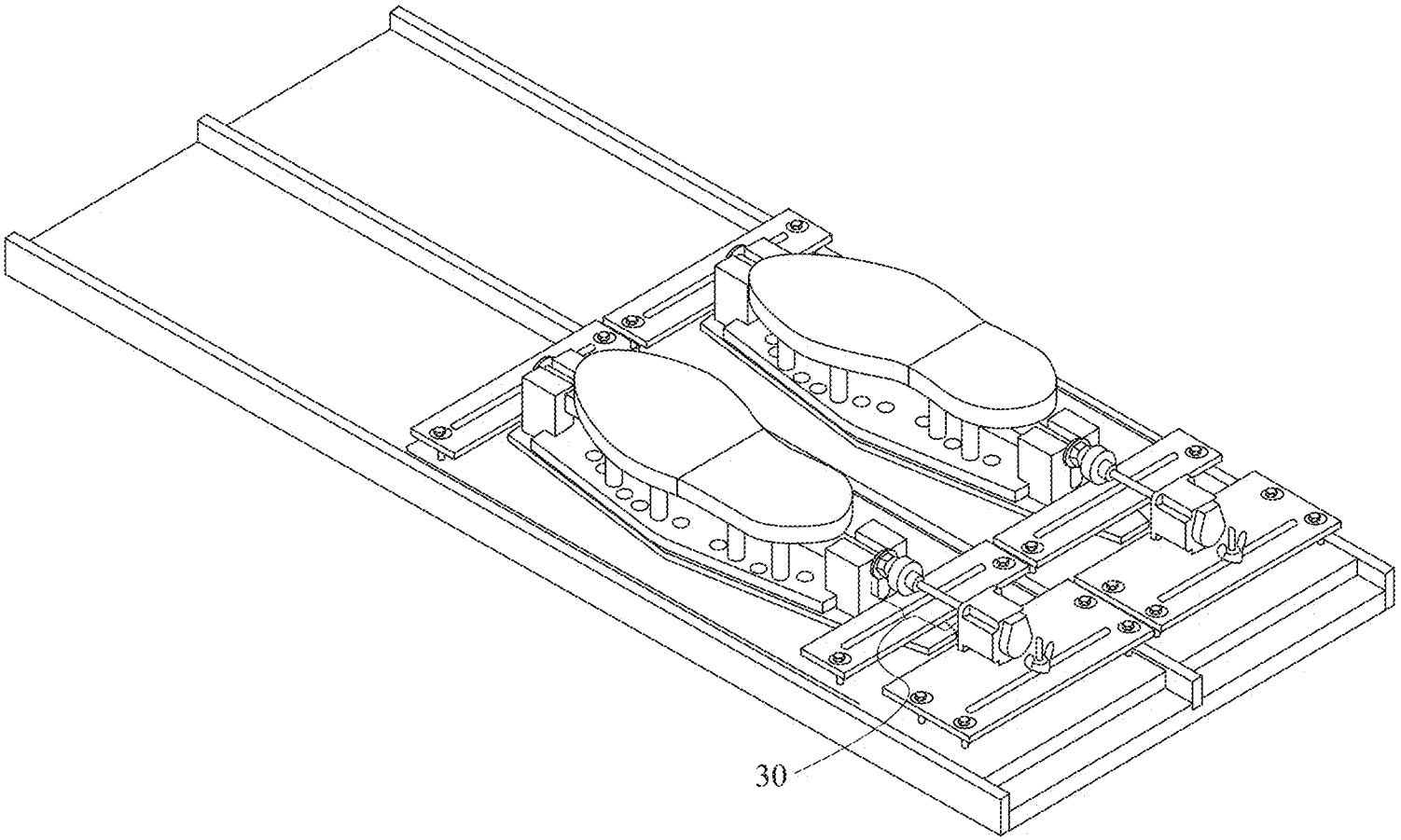
FIG. 5 shows a perspective view, of the platform 2, similar to that represented in FIG. 2. In particular.

In its preferred embodiment, the posture rehabilitation apparatus 1 according to the present invention comprises a rectangular-shaped platform 2, adapted to offer support to the feet of the use subject of the apparatus 1, at least one belt 3 with elastic band, having projections 28 adapted for the iliac wings of the user subject, and to which at least one elastic cord 4 is applied. The apparatus 1 also comprises an anchorage system having at least four telescopic rods 5. More in detail, in its preferred embodiment, the apparatus 1 comprises a platform 2 adapted to house at least two portions and in particular two longitudinal portions 2' and 2" with equal width. Each of said portions 2' and 2" also houses a base 6 and more in detail the portion 2' houses the base 6', while the portion 2" houses the base 6". Said bases 6' and 6" are respectively adapted to receive the support of the left and right feet of the user of the apparatus 1. In particular, the base 6' is adapted to sustain the support 7', while the base 6" is adapted to sustain the support 7". Said supports 7' and 7" are also respectively profiled in accordance with the left foot and the right foot. The bases 6' and 6", on which said supports 7' and 7" are housed, are also reversibly joined to the platform 2 by means of at least one removable common dowel 24 to be arranged in a corresponding hole/holes 23 arranged on the side of said bases 6' and 6". Each support 7' and 7" is further subdivided into two portions of which one corresponds with the forefoot, the other with the rearfoot. More in detail, the support 7' is transversely subdivided into two portions, i.e. into the portion 8', corresponding with the left forefoot and into the portion 8" corresponding with the left rearfoot, while the support 7" is transversely subdivided into two portions and in particular into the portion 9' corresponding with the right forefoot and into the portion 9" corresponding with the right rearfoot. The upper surface of the bases 6' and 6", on which said supports 7' and 7" are situated, is also flat, anti-slip and optionally provided with a baropodometric detection system. Also indicated on such surface are the length and position references of the foot in relation to the tarsometatarsal articulations. The supports 7' and 7" and more in detail their transverse portions 8' and 8" for the support 7' and the portions 9' and 9" for the support 7" are also movable with respect to each other. Still more in detail, the portion 8' is movable with respect to the portion 8", and is constrained to the latter only by a cylindrical rod 10, preferably made of steel, which allows the rotation movement of said two portions 8' and 8" with respect to the longitudinal barycentric axis of said rod 10. An analogous movement due to an analogous rod 10 also involves the portion 9' and the portion 9" of the support 7". The constraint that joins the two pairs of portions, i.e. the portion 8' to the portion 8" and the portion 9' to the portion 9", is obtained also due to the presence of pairs of elements 11 and 12 and 11' and 12' respectively integral with the portions 8' and 8" and with the portions 9' and 9". More in detail, said pairs of elements 11 and 12, and 11' and 12' are shaped in a manner such to constitute a housing for the cylindrical rod 10 and also in a manner such to allow the rotation around said rod 10 by the portions 8' and 8" and 9' and 9". This configuration is obtained in order to allow the physiological helical movement between the forefoot and the rearfoot. The apparatus 1 according to the present invention is also such to have at least one hole 13 and preferably eight holes 13 on the lateral surface of the portions 8' and 9' and at least one hole 14 and preferably four holes 14 on the lateral surface of the portions 8" and 9". Said holes 13 and said holes 14 are adapted to house a reference rod 15 applicable in order to quantify on a graduated scale the movement around the longitudinal barycentric axis. One of the most important and distinctive characteristics of the posture rehabilitation apparatus 1 according to the present invention is that of giving the user subject of the apparatus 1 a high number of degrees of freedom of movement. The contribution of this important characteristic is also given by the fact that the lower faces of the portions 8' and 9' have at least ten holes 16, arranged along the perimeter, and preferably at least fifteen holes 16 coinciding with the same number of holes 16 arranged on the surface of supports 7' and 7" respectively below the support 7' and the support 7" and respectively resting on an anti-slip polycarbonate layer 27 present on the bases 6' and 6" in turn housed on the platform 2. Said holes 16 are adapted to house springs 18 which can have different, suitable rigidity. At the lower surface of the portions 8' and 9' and 8" and 9" of the supports 7' and 7", at least two lateral fins 19 are optionally present per portion, such fins are integral with measuring rods obtained with pin screws or equivalent electro-hydraulic control elements. Said fins 19 are adapted to allow the adjustment of the height and/or the inclination of the foot with respect to the ground.

As mentioned above, the present apparatus comprises at least one belt 3 with elastic band adapted to be worn by the user subject of the apparatus 1. More in detail, the belt 3 is provided with an opening/closing system with Velcro and with at least two fixing points 21 and preferably at least four fixing points 21 for the elastic cords 4. Said elastic cords 4 are also connected to supports 22 arranged on the front part, and/or upper part and/or side of the subject, supported by the telescopic rod system 5 which allows the fixing of said supports 22 at a predetermined height. The apparatus 1, object of the present document, optionally also comprises reference axes 25 arranged on the medial and/or lateral side/sides and which allow the subject to execute a specific exercise in relation to inversion and eversion movements of the foot.

The posture rehabilitation apparatus 1 is also optionally integrated with a common video system 26 capable of projecting images of the region of the anatomic structure and in particular of the foot/feet affected by the exercise.

In another embodiment, the posture rehabilitation apparatus 1 has, in place of the springs 18, represented by common metallic elastic systems, a plurality of hydraulic actuators 30 directly managed by a software adapted to vary the resistance thereof as a function of the desired variability of the exercise. More in detail, the actuators 30 in question are represented by pneumatic cylinders provided with a common electric motor adapted to allow the rotation with respect to the central axis. The pneumatic cylinders comprised in the apparatus 1 of the invention have a diameter comprised between 8 mm and 20 mm and preferably a diameter of about 10 mm in order to allow sustaining the weight of a person with a suitable safety coefficient, even if working at relatively low pressures (on the order of 1.0-2.0 bar), in a manner so as to reduce the compressor power to be used. Such diameter also allows resisting transverse forces which, for common pneumatic cylinders, are not usually taken into account in the design stage.

The software comprised in the apparatus 1 described in the present document is a common information system available in the market, adapted to create and manage the resistance of said actuators in relation to the multiple variables provided by the exercise itself, the anthropometric data of the specific subject and the possible pathology suffered.

The software, in this particular embodiment, is also interfaced with the baropodometric detection present on the surface that houses the foot of the patient.

The invention claimed is:

1. A posture rehabilitation apparatus adapted to rehabilitation of alterations of a locomotor system caused by rheumatic and traumatic diseases, comprising:

a rectangular-shaped platform housing first and second portions having an identical shape and extension adapted to receive a user subject in an upright position and/or in a gait cycle, said first portion and said second portion respectively comprising a first base and a second base reversibly respectively fixed to said first and second portions and to respectively sustain a first support adapted to match a left foot of the subject and the second support adapted to match a right foot of the subject, said first support and said second support respectively having a left foot profile and a right foot profile;

a cord support;

telescoping rods that fix said cord supports at a predetermined height;

an elastic band belt adapted to be worn by the subject and having an opening and closing system and at least one fixing point for connection of an elastic cord to said belt, when worn by the subject, with the cord support, wherein the telescoping rods are vertically adjustable to adjust a height of the cord support relative to the subject;

wherein the first support and the second support are arranged above the respective first and second bases at a predetermined height, with each of the first support and the second support being divided into two transverse portions which allow a foot to perform natural helical movement of the foot, said first portion being transversely divided into a left forefoot profiled portion and a left rearfoot profiled portion, said second portion being transversely divided into a right forefoot profiled portion and a right rearfoot profiled portion, the left forefoot profiled portion being moveable with respect to the left rearfoot profiled portion, the right forefoot profiled portion moveable with respect to the right rearfoot profiled portion, the left forefoot profiled portion, the left rearfoot profiled portion, the right forefoot profiled portion, and the right rearfoot profiled portion each having, on lower surfaces thereof, respective first and second cylindrical and longitudinal rods with respect to a barycenter longitudinal axis of the left forefoot profiled portion, the left rearfoot profiled portion, the right forefoot profiled portion, and the right rearfoot profiled portion such that the portions are free to perform the helical movement of the foot.

2. The posture rehabilitation apparatus according to claim 1, wherein, the first cylindrical and longitudinal rod constrains the left forefoot profiled portion to the left rearfoot profiled portion, the second cylindrical and longitudinal rod constrains the right forefoot profiled portion to the right rearfoot profiled portion, the left forefoot profiled portion, the left rearfoot profiled portion, the right forefoot profiled portion, and the right rearfoot profiled portion each respectively having, on the lower surfaces thereof, i) a first pair of elements integral with the left forefoot profiled portion and the left rearfoot profiled portion and ii) a second pair of elements integral the right forefoot profiled portion and the right rearfoot profiled portion, the first pair of elements housing the first cylindrical and longitudinal rod and the second pair of elements housing the second cylindrical and longitudinal rod.

3. The posture rehabilitation apparatus according to claim 2, further comprising:

a first sustainment element housed on the first base and underlying the first support;

a second sustainment element housed on the second base and underlying the second support; and a plurality of springs underlying the first support and the second support, said springs being inserted in a plurality of holes present on the lower surface of the left forefoot profiled portion, the left rearfoot profiled portion, the right forefoot profiled portion, and the right rearfoot profiled portion, and further being inserted in holes present on the first and second sustainment elements.

4. The posture rehabilitation apparatus according to claim 3, further comprising:

lateral holes on lateral surfaces of the left forefoot profiled portion, the left rearfoot profiled portion, the right forefoot profiled portion, and the right rearfoot profiled portion, and a reference rod insertable in the lateral holes to thereby quantify, on a graduated scale, movement around the barycenter longitudinal axis.

5. The posture rehabilitation apparatus according to claim 3, further comprising an anti-slip layer interposed between upper surface of the first and second bases and the lower surface of the first and second sustainment elements.

6. The posture rehabilitation apparatus according to claim 1, further comprising at least two lateral fins, arranged on the lower surface of each the left forefoot profiled portion, the left rearfoot profiled portion, the right forefoot profiled portion, and the right rearfoot profiled portion, of the first and second supports, adapted to allow the adjustment of at least one of the group consisting of height and inclination of the foot with respect to the ground.

7. The posture rehabilitation apparatus according to claim 1, further comprising a dowel that reversibly and respectively fixes the first and second bases to the first and second portions.

8. The posture rehabilitation apparatus according to claim 1, wherein the elastic band belt comprises projections adapted to offer greater support and stability to the subject, said projections configured to match iliac wings of the subject.

9. The posture rehabilitation apparatus according to claim 1, further comprising a video system that projects images of a region of an anatomic structure of the subject.

10. The posture rehabilitation apparatus according to claim 1, further comprising:

actuators comprising hydraulic cylinders with a diameter between 8 mm and 20 mm, adapted to allow the rotation around a central axis of the first and second supports; and an electric motor that varies a resistance of the actuators, the electric motor being managed by a software adapted to vary the resistance as a function of a desired variability of exercise.

11. The posture rehabilitation apparatus according to claim 1, further comprising a reference axis attached to the telescoping rods, the reference axis arranged at at least one of the group consisting of a medial side and a lateral side of the subject and adapted to facilitate a rehabilitation operation, conferring a high number of degrees of freedom of movement to anatomic structures of the subject.

12. The posture rehabilitation apparatus according to claim 1, further comprising:

a first sustainment element housed on the first base and underlying the first support;

a second sustainment element housed on the second base and underlying the second support; and a plurality of springs underlying the first support and the second support, some of said springs being inserted in a plurality of holes present on the lower surface of the left forefoot profiled portion, the left rearfoot profiled portion, the right forefoot profiled portion, and the right rearfoot profiled portion, and further of said springs being inserted in holes present on the first and second sustainment elements.

13. The posture rehabilitation apparatus according to claim 1, further comprising:

lateral holes on lateral surfaces of the lower surface of the left forefoot profiled portion, the left rearfoot profiled portion, the right forefoot profiled portion, and the right rearfoot profiled portion, and a reference rod insertable in the lateral holes to thereby quantify, on a graduated scale, movement around the longitudinal barycenter axis.

14. A posture rehabilitation apparatus adapted to rehabilitation of alterations of a locomotor system of a user subject caused by rheumatic and traumatic diseases, the apparatus comprising:

a platform having a longitudinal direction and housing first and second portions arranged side-by-side, each of the first and second portion having a longitudinal extension receiving the subject in an upright position or in a gait cycle, said first portion and said second portion respectively comprising a first base and a second base respectively fixed to said first and second portions, the first base and the second base respectively sustaining a first support and a second support, the first support being a left foot support with a left foot profile and the second support being a right foot support with a right foot profile;

telescoping rods on a first and second longitudinal side of the platform;

a support element connected to a pair of the telescoping rods, the support element extending across the platform from the first longitudinal side of the platform to the opposite, second longitudinal side of the platform;

a belt, adapted to be worn by the subject, the belt being connected to the support element via a cord, wherein the first support and the second support are respectively arranged above the first and second bases, with each of the first support and the second support being divided into two transverse portions which allow a foot to perform natural helical movements, said first portion being transversely divided into a left forefoot profiled portion and a left rearfoot profiled portion, the left forefoot profiled portion being moveable with respect to the left rearfoot profiled portion, said second portion being transversely divided into a right forefoot profiled portion and a right rearfoot profiled portion, the right forefoot profiled portion moveable with respect to the right rearfoot profiled portion, the left forefoot profiled portion, the left rearfoot profiled portion, the right forefoot profiled portion, and the right rearfoot profiled portion each having, on lower surfaces thereof, respective first and second cylindrical and longitudinal rods with a barycenter longitudinal axis, wherein i) the first cylindrical and longitudinal rod allows rotation of the left forefoot profiled portion and the left rearfoot profiled portion with respect to the barycenter longitudinal axis of the first cylindrical and longitudinal rod, thereby allowing helical movements of the left foot, and ii) the second cylindrical and longitudinal rod allows rotation of the right forefoot profiled portion and the right rearfoot profiled portion with respect to the barycenter longitudinal axis of the second cylindrical and longitudinal rod, thereby allowing helical movements of the right foot.

15. The posture rehabilitation apparatus according to claim 14, wherein, the first cylindrical and longitudinal rod constrains the left forefoot profiled portion to the left rearfoot profiled portion, the second cylindrical and longitudinal rod constrains the right forefoot profiled portion to the right rearfoot profiled portion, the left forefoot profiled portion, the left rearfoot profiled portion, the right forefoot profiled portion, and the right rearfoot profiled portion each respectively having, on the lower surfaces thereof, i) a first pair of elements integral with the left forefoot profiled portion and the left rearfoot profiled portion and ii) a second pair of elements integral the right forefoot profiled portion and the right rearfoot profiled portion, the first pair of elements housing the first cylindrical and longitudinal rod and the second pair of elements housing the second cylindrical and longitudinal rod.

16. The posture rehabilitation apparatus according to claim 15, further comprising:

a first sustainment element housed on the first base and underlying the first support;

a second sustainment element housed on the second base and underlying the second support; and a plurality of springs extending between i) the first second supports, and ii) the first and second sustainment elements.

17. The posture rehabilitation apparatus according to claim 16, further comprising:

lateral holes on lateral surfaces of the left forefoot profiled portion, the left rearfoot profiled portion, the right forefoot profiled portion, and the right rearfoot profiled portion, and a reference rod insertable in the lateral holes to thereby quantify, on a graduated scale, movement around the longitudinal barycenter axis.

18. The posture rehabilitation apparatus according to claim 16, further comprising:

lateral fins arranged on each of the left forefoot profiled portion, the left rearfoot profiled portion, the right forefoot profiled portion, and the right rearfoot profiled portion, the lateral fins being adapted to allow the adjustment of at least one of the group consisting of height and inclination of the left forefoot profiled portion, the left rearfoot profiled portion, the right forefoot profiled portion, and the right rearfoot profiled portion with respect to ground.

19. The posture rehabilitation apparatus according to claim 14, further comprising a dowel that reversibly and respectively fixes the first and second bases to the first and second portions.

20. The posture rehabilitation apparatus according to claim 14, further comprising:

actuators comprising hydraulic cylinders with a diameter between 8 mm and 20 mm, the actuators adapted to allow the rotation around a central axis of the first and second supports; and an electric motor that varies a resistance of the actuators to the rotation around the central axis of the first and second supports.

* * * * *